United States Patent [19]

Jordan et al.

[11] 4,014,114

[45] Mar. 29, 1977

[54] SPIKE CLUSTER

[75] Inventors: Ulice A. Jordan; Governor V. Quinn, both of East St. Louis, Ill.

[73] Assignee: Three Line Research & Development Co., Inc., Granite City, Ill.

[22] Filed: Nov. 28, 1975

[21] Appl. No.: 635,892

[52] U.S. Cl. ..... 36/67 D

[51] Int. Cl.[2] ..... A43C 15/00

[58] Field of Search ..... 36/67 D, 67 A, 67 B, 36/134, 59 R

[56] References Cited

UNITED STATES PATENTS

| | | | |
|---|---|---|---|
| 3,054,197 | 9/1962 | Morgan et al. | 36/67 D |
| 3,512,275 | 5/1970 | Leavitt | 36/67 D |
| 3,656,245 | 4/1972 | Wilson | 36/67 D |
| 3,844,056 | 10/1974 | Kwan | 36/67 D |

*Primary Examiner*—Patrick D. Lawson
*Attorney, Agent, or Firm*—Rogers, Eilers & Howell

[57] ABSTRACT

A spike cluster adapted for attachment to the bottom of an athletic shoe includes a body having a concavity in its upper face with a rim at the periphery of the upper face surrounding the concavity. Means are provided on the upper face of the body for attachment thereof to the bottom of a shoe. A plurality of spikes are located near the periphery of the lower face of the body and extend downwardly therefrom. Each spike has a vertical bore therein, open at the bottom and acting to provide improved traction, particularly on wet surfaces. A protrusion on the lower face within the area bounded by the spikes also extends below the lower face. The cluster may be secured to the bottom of an athletic shoe with the rim providing a clamping surface around the upper margin of the cluster for frictional engagement with the bottom of the shoe. Thus, movement of the cluster relative to the shoe under the stress of use is resisted. The protrusion acts as a shedder to prevent accumulation of dirt between the spikes.

11 Claims, 8 Drawing Figures

SPIKE CLUSTER

BACKGROUND OF THE INVENTION

This invention relates to the field of athletic equipment and more particularly to a novel spike cluster adapted for attachment to the bottom of an athletic shoe, especially a track shoe.

A continuing need has existed for the development of improved spike clusters for attachment to athletic shoes. In particular, a need has existed for clusters having improved traction, particularly on wet synthetic track surfaces, and yet are durable and resist movement relative to the shoe during competition.

Spike clusters generally of the type described herein are known in the art, but the tips of such spikes have been relatively flat or smooth and thus have had a tendency to slide, or lose traction on wet synthetic surfaces. Thus, the primary improvement of this invention over prior art spike cluster designs is in the vertical bores or recesses provided in each spike, as will be hereinafter more fully described.

SUMMARY OF THE INVENTION

It is an object of the present invention, therefore, to provide an improved detachable spike cluster which can be securely attached to the bottom of an athletic shoe, particularly a track shoe and to provide such a cluster with improved traction characteristics, particularly on wet synthetic surfaces. A further object is to provide such a cluster with vertical bores or recesses in each spike. It is a further object of the invention to provide such a spike cluster having a high resistance to breakage or movement relative to the shoe during competition. Another object is to provide a cluster which resists accumulation of dirt or other foreign matter between its spikes.

Briefly, the present invention is directed to a spike cluster adapted for attachment to the bottom of an athletic shoe. The cluster comprises a body having a concavity in one face thereof constituting its upper face with a rim at the periphery of said upper face surrounding the concavity. There are means on the upper face of the body for attachment thereof to the bottom of a shoe and a plurality of spikes located near the periphery of the other or lower face of said body, said spikes extending down from said lower face and spaced therearound. There is a protrusion on the lower face within the area bounded by the spikes and extending below said lower face. Each spike has a vertical bore or recess open at the bottom end and closed at the top. Thus, the cluster may be secured to the bottom of a shoe with the rim providing a clamping surface all around the upper margin of the cluster for frictional engagement with the bottom of the shoe to resist movement of the cluster relative to the shoe under the stress of use. The protrusion acts as a shedder so that an accumulation of dirt between the spikes is avoided and the vertical bores act as means providing improved traction, particularly on wet surfaces. Other objects and features will be apparent from the detailed description to follow.

BRIEF DESCRIPTION OF THE DRAWINGS

Corresponding reference characters indicate the corresponding parts throughout the several views of the drawings.

DESCRIPTION OF THE PREFERRED EMBODIMENTS

Figure 1:
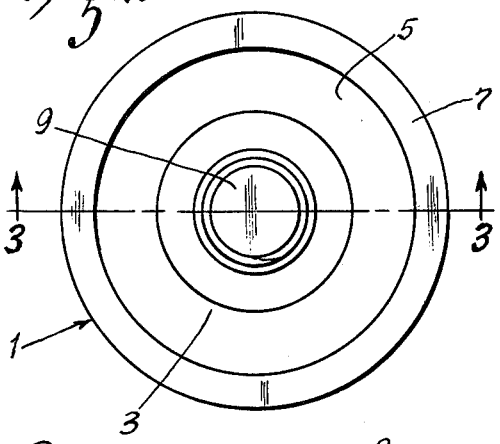
FIG. 1 is a top plan view of one embodiment of the spike cluster of the invention.
Figure 5:
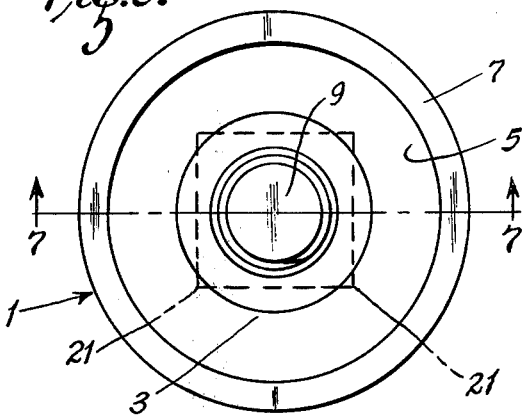
FIG. 5 is a top plan view showing another embodiment of the novel spike cluster.
Figure 2:
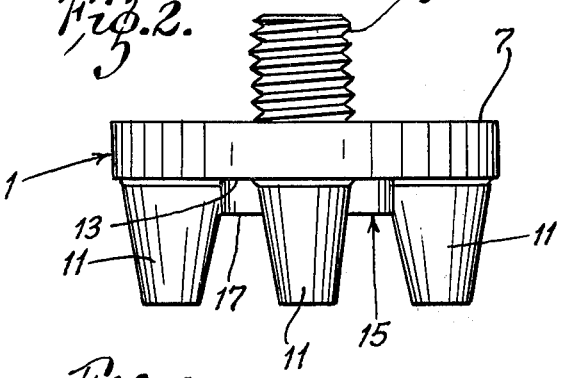
FIG. 2 is an elevation of the cluster of FIG. 1.
Figure 6:
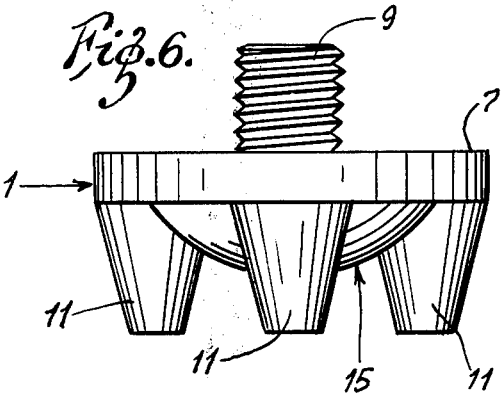
FIG. 6 is an elevation of the cluster of FIG. 5.
Figure 3:
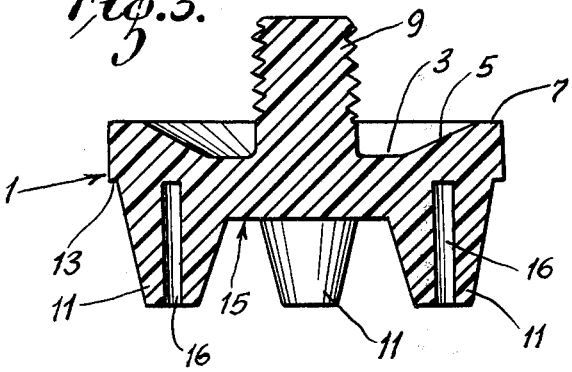
FIG. 3 is a sectional view taken along the line 3—3 of FIG. 1.
Figure 7:
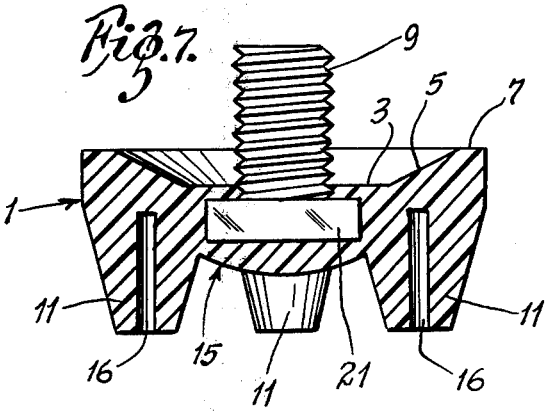
FIG. 7 is a sectional view taken along line 7—7 of FIG. 5.
Figure 4:
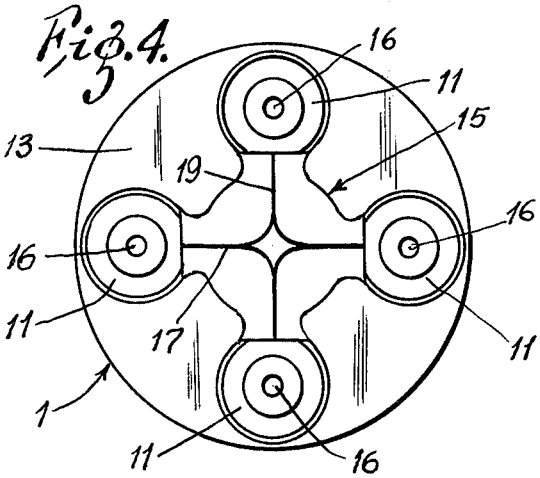
FIG. 4 is a bottom plan view of the cluster of FIG. 1.
Figure 8:
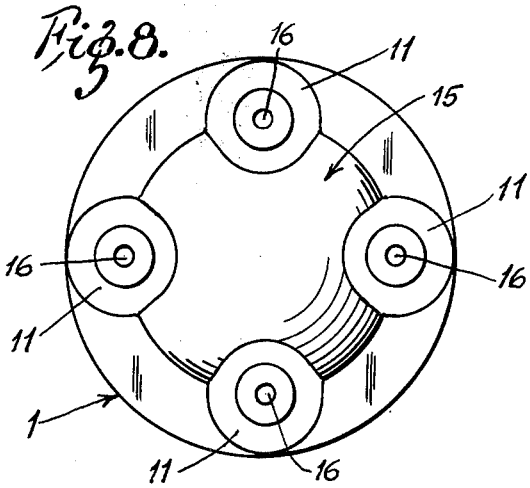
FIG. 8 is a bottom plan view of the cluster of FIG. 5.

Two embodiments of the invention are illustrated by the drawings. FIGS. 1–4 show an embodiment having an integral screw or attachment means with a cruciform shedder. FIGS. 5–8 show a second embodiment wherein the screw is a separate element having a head embedded in the body of the cluster with a dome-shaped shedder.

In each embodiment the novel cluster comprises a plate or body 1 having a truncated conical concavity 3 in its upper face 5, with a rim 7 at the periphery of face 5 surrounding concavity 3. Means for attachment of the cluster to the bottom of an athletic shoe is constituted by screw 9 located centrally of and extending outwardly from face 5. Four spikes 11 extend down from lower face 13 of body 1 near the periphery of said face and are spaced therearound at 90° intervals. With this arrangement, the cluster has two pairs of spikes in diametrical planes at right angles to each other. A protrusion 15 extends below lower face 13 within the area bounded by spikes 11.

Each spike is tapered with its narrow end at the bottom, and is preferably frustoconical in shape. Each of the spikes has a vertical bore or recess 16 therein, the recess being open at the bottom and closed at the top and preferably extending up into the spike to approximately the lower face 13 of the body 1.

The vertical bores or recesses 16 in the spikes 11 are a primary feature of this invention, providing improved traction, particularly on wet synthetic track surfaces. This is believed to result for several reasons. Most synthetic track surfaces are somewhat spongy to provide some resilience, and thus less strain on the runner's legs. Because they are spongy, it is believed that the surface of the track tends to protrude slightly upwardly into the bores 16 as the lower ends of the spikes dig into the surface. When the spikes are removed from the surface, as when the wearer is running, there is a slight suction to provide increased traction. While the amount of such suction is slight, the cumulative effect where there are a number of such clusters on a single shoe, such as 16 or so, is significant. It is also believed that the bores 16 provide a cavity into which water on a wet track surface can go, thus leaving the surfaces of the bottoms of the spikes which contact the track relatively free of water to provide improved traction. It is further believed that the ring surface at the bottom of each spike formed by the bore, provides a better bite into the track surface than if the spike were smooth at the bottom. Thus, it is believed that all of these factors contribute to improved traction.

The spike clusters of this invention can be formed of any suitable material, such as LEXAN, nylon reinforced plastic with a glass fill, steel, aluminum or the like. They may be formed by molding, and the bores 16 can either be formed during the molding process or thereafter machined.

It is believed preferable that the bores 16 extend from the bottom surfaces of the spikes upwardly to approximately the lower face 13 of the body 1 to provide large enough cavities for the displacement of water. By way of example, each spike is approximately ⅜ inch to ⅝ inch in length l, measured as shown in the drawing, and approximately ⅛ inch in diameter at its bottom surface. Each bore 16 is approximately 1/16 inch in diameter and extends the full length of the spike. The diameter of the bore is approximately half the diameter of the bottom surface of the spike.

In the embodiment of FIGS. 1–4, screw 9 is an integral part of the cluster which is molded in one piece. The protrusion 15 of this embodiment is constituted by two ridges 17 and 19 extending down from face 13. Ridge 17 extends between one of the pairs of spikes which lie in a first diametrical plane, and ridge 19 extends between the other pair lying in a second diametrical plane at right angles to the first. The two ridges are thus mutually perpendicular and constitute a cruciform protrusion.

In the embodiment of FIGS. 5–8, screw 9 is fabricated of metal while the remainder of the cluster, including body 1 and spikes 11, is molded. In this embodiment screw 9 has a head 21 which is embedded in body 1. Head 21 partially extends into the interior of protrusion 15 and the latter is constituted by a downwardly domed part of body 1. The outer boundary of this domed portion intersects spikes 11.

The screw of the spike cluster of the invention is adapted to be threaded in a tapped hole in the bottom of a track shoe or other athletic shoe for secure attachment thereto. Rim 7 provides a clamping surface all around the upper margin of the cluster for engagement with the bottom of the shoe. Because the clamping surface is at the periphery of face 5 it provides frictional resistance to movement by turning of the screw. This frictional resistance is exerted over an area surrounding the screw at a substantial distance or radius from the screw axis. As a consequence, the product of the frictional force and the radius provide a relatively large moment for resistance to external turning forces exerted on the cluster during competition.

The embodiment of FIGS. 5–8 is especially advantageous for use where particularly heavy stresses are incurred during use. The metal screw is resistant to the breakage which could occur in a plastic screw where the cluster is attached to a shoe used, for example, by a mature sprinter.

Because of the proximity of the spikes in a spike cluster, a tendency exists for dirt or other foreign objects to accumulate between the spikes, especially, for example, if a track athlete walks across a muddy infield prior to or between participation in events. The protrusion located inward of the spikes of the cluster of the invention acts as a shedder which tends to break up dirt particles coming between the spikes and consequently to prevent build-up of mud, dirt or other materials in this region. Both the cruciform shedder of FIGS. 1–4 and the domed shedder of FIGS. 5–8 have been found to be effective for this purpose.

In view of the above, it will be seen that the several objects of the invention are achieved and other advantageous results attained.

Various changes and modifications may be made in this invention, as will be readily apparent to those skilled in the art. Such changes and modifications are within the scope and teaching of this invention as defined by the claims appended hereto.

What is claimed is:

1. A spike cluster adapted for attachment to the bottom of an athletic shoe, said cluster comprising a body portion, means on the body portion for attachment thereof to the bottom of a shoe, and a plurality of spikes extending downwardly from said body portion, each spike having a vertical bore therein open at the bottom of said spike.

2. The spike cluster of claim 1 wherein said bores are closed at their tops and extend substantially the full lengths of the spikes.

3. The spike cluster of claim 1 further comprising four spikes spaced at 90° intervals about the lower face of said body portion, there being two pairs of spikes in two diametrical planes at right angles to each other.

4. The spike cluster of claim 3 further comprising two ridges extending down from the lower face of said body portion, one ridge extending between one pair and the other ridge extending between the other pair of spikes, said ridges forming a cruciform shedder.

5. The spike cluster of claim 4 wherein said cluster is molded in one piece.

6. The spike cluster of claim 1 wherein the means for attachment of the body portion to a shoe further comprises a screw centrally located of and extending upwardly from the body portion adapted to be threaded in a tapped hole in the bottom of the shoe.

7. The spike cluster of claim 1 further comprising a dome shaped protrusion extending downwardly from the lower face of said body portion and having its outer boundary intersecting said spikes.

8. The spike cluster of claim 6 wherein the body portion and spikes are molded of plastic and said screw is made of metal and has a head embedded in said body portion.

9. A spike cluster adapted for attachment to the bottom of an athletic shoe, said cluster comprising a body portion, means on the body portion for attachment thereof to the bottom of a shoe, and a plurality of spikes extending downwardly from said body portion, each spike having a vertical bore therein which is closed at the top and open at the bottom and which extends substantially the full length of the spike, each spike being tapered with its end of least dimension being at the bottom, the width dimension of the bore being approximately half the width dimension of the spike at the bottom end.

10. A spike cluster adapted for attachment to the bottom of an athletic shoe, said cluster comprising a body portion, means on the body portion for attachment thereof to the bottom of a shoe, and a plurality of spikes extending downwardly from said body portion, said spikes being frustrum in shape with the end of least diameter at the bottom, each spike having a vertical bore therein open at the bottom and closed at the top, said bore extending substantially the full length of the spike and the diameter of the bore being approximately half the diameter of the bottom end of the spike.

11. A spike cluster adapted for attachment to the bottom of an athletic shoe, said cluster comprising a body portion, means on the body portion for attachment thereof to the bottom of a shoe, and a plurality of spikes extending downwardly from said body portion, each spike having a vertical bore therein open at the bottom of said spike, said body portion having a concavity in its upper face with a rim at the periphery of said upper face surrounding the concavity, said attachment means extending upwardly from said upper face, said spikes being located near the periphery of the lower face of said body portion, and a protrusion on said lower face of said body portion within the area bounded by said spike and extending a distance below said lower face.

* * * * *